US006462468B1

(12) United States Patent
Jones et al.

(10) Patent No.: US 6,462,468 B1
(45) Date of Patent: Oct. 8, 2002

(54) POLYMER THICK FILM ELECTROLUMINESCENT ANIMATION AND BACK LIGHTING ON A GLASS SUBSTRATE

(75) Inventors: Barrie M. Jones, Knoxville, TN (US); Mark A. Kimmet, Knoxville, TN (US)

(73) Assignee: Polymore Circuit Technologies, Maryville, TN (US)

( * ) Notice: Subject to any disclaimer, the term of this patent is extended or adjusted under 35 U.S.C. 154(b) by 184 days.

(21) Appl. No.: 09/624,683

(22) Filed: Jul. 24, 2000

(51) Int. Cl.[7] ..... B05D 5/06

(52) U.S. Cl. ..... 313/498; 313/505; 313/506; 445/24

(58) Field of Search ..... 313/498, 505, 313/506, 509; 445/24, 58, 66

(56) References Cited

U.S. PATENT DOCUMENTS 5,720,639 A * 2/1998 Stevenson ..... 445/24
5,980,976 A * 11/1999 Burrows ..... 427/66
6,054,809 A * 4/2000 Haynes et al. ..... 313/505

* cited by examiner

*Primary Examiner*—Vip Patel
*Assistant Examiner*—Ken A Berck
(74) *Attorney, Agent, or Firm*—Pitts & Brittian PC

(57) ABSTRACT

An apparatus for providing lighted areas on a surface. The apparatus comprises a glass substrate having at least a first surface that includes a substantially clear substantially conductive layer, and a second surface that does not include a substantially clear substantially conductive layer. The present apparatus also includes a polymer thick film phosphor ink layer applied to the first surface of the glass substrate, a polymer thick film dielectric layer applied to at least a portion of the phosphor ink layer, and a polymer thick film conductive layer applied to at least a portion of the dielectric layer. Further, the apparatus includes power connectors for connecting electrical power to the polymer thick film conductive layer and to the substantially clear substantially conductive layer of the glass substrate. When power is applied to the power connectors, the polymer thick film phosphor ink layer illuminates and light substantially shows through the second surface of the glass substrate. There is also an apparatus for providing animated lighted areas on a surface.

13 Claims, 2 Drawing Sheets

POLYMER THICK FILM ELECTROLUMINESCENT ANIMATION AND BACK LIGHTING ON A GLASS SUBSTRATE

FIELD OF THE INVENTION

The present invention relates to methods and apparatus for providing lighted areas on a glass or similar surface. More particularly, the present invention relates to those methods and apparatus that use polymer thick film (PTF) technology to selectively provide such lighted areas. Such methods and apparatus are used as back lighting of the glass or similar substrate or for animation of the lighted areas on the glass or similar substrate.

BACKGROUND OF THE INVENTION

It is often quite useful to be able to provide light in a limited amount and over a limited area. Without meaning to limit the scope of the present invention, typical examples of such uses are with respect to night lights, the sources of light to set moods, and the back lighting of pictures or other materials.

It is often desirable to provide light in a limited amount and over a limited area. A discussion of the use of back lighting provides an illustration of a useful solution in such situations as well as the problems associated the current technology for treating circumstance such as those.

Back lighting is used to illuminate an illustration from behind. Such back light systems are used, for example, to set a mood in a room, to provide low-level lighting in a substantially darkened area such as a theater, or to display advertising at a point of sale. The illustration is mounted such that a light source is behind the illustration from the point of view of the observer. When the light source is turned off in a moderately dark environment, the illustration is generally not visible and when the light source is turned on, the observer can see the illustration clearly.

One technology for back lighting illustrations involves the use of an incandescent or fluorescent bulb in combination with a diffuser in an attempt to produce a relatively even distribution of light across the subject. Often, the diffuser causes a loss of light from the source and, usually, results in back lighting that is unevenly distributed. Generally, the light is brightest in the vicinity of the bulb and dimmer at the edges of the diffuser. Where the diffuser produces a relatively even distribution of light, the amount of light coming from the diffuser is significantly reduced from the amount originally emitted from the bulb. Further, back light systems that use bulbs often produce much heat that may damage the illustration over time.

Also, many current back light systems are relatively bulky. The light source and the diffuser are usually mounted in a box-like arrangement that occupies a significant amount of space. Such systems could not be subtly mounted on a wall; they would extend out from the plane of the wall so far as to generally disturb the aesthetic nature of the illustration. Further, the construction of such back light boxes is usually difficult and expensive.

There are back light systems that are not as bulky as the ones using incandescent or fluorescent lights. Polymer thick film thermoplastic materials have been applied to thin flexible substrates (such as Mylar® or polyester sheets) and used as backlights in, for example, wristwatches. The polymer thick film (PTF) thermoplastic inks tend to shrink and cause the flexible substrate to curl rendering it unsuitable for multiple layering which is a necessary trait for animated displays or back lights.

Thus, it is highly desirable to provide a system for producing light over a limited area where the system is characterized by compactness, simplicity of construction and economy of manufacture.

Therefore, it is an object of the present invention to provide an apparatus that will allow the production of light over a limited area.

It is a further object of the present invention to provide such an apparatus that is compact in construction.

It is an additional object of the present invention to provide such an apparatus that is simple to construct.

It is yet another object of the present invention to provide such an apparatus that is relatively inexpensive to manufacture.

Consideration of the specification, including the several figures to follow, will enable one skilled in the art to determine additional objects and advantages of the invention.

SUMMARY OF THE INVENTION

Having regard to the above and other objects and advantages, the present invention generally provides for an apparatus for providing lighted areas on a surface. The apparatus comprises a glass substrate having at least a first surface that includes a substantially clear substantially conductive layer, and a second surface that does not include a substantially clear substantially conductive layer. The present apparatus also includes a polymer thick film phosphor ink layer applied to the first surface of the glass substrate, a polymer thick film dielectric layer applied to at least a portion of the phosphor ink layer, and a polymer thick film conductive layer applied to at least a portion of the dielectric layer. It should be noted that the polymer thick film materials referred to in the present specification are polymer thick film thermoset materials. These thermoset materials are much more suitable for multi-layering than are polymer thick film thermoplastic materials. Further, the apparatus includes power connective means for connecting electrical power to the polymer thick film conductive layer and to the substantially clear substantially conductive layer of the glass substrate. When power is applied to the power connective means, the polymer thick film phosphor ink layer illuminates and light substantially shows through the second surface of the glass substrate.

In a preferred embodiment of the present invention, the polymer thick film conductive layer includes a material selected from the group consisting of copper, silver, gold, and carbon. In yet another preferred embodiment of the present invention, the power connective means is attached to at least a portion of the polymer thick film conductive layer by use of a solder connection, a conductive adhesive, compression of a conductive leaf spring on the polymer thick film conductive strip and the substantially clear substantially conductive layer, or compression of conductive rubber on the polymer thick film conductive strip and the substantially clear substantially conductive layer.

In a further preferred embodiment of the present invention, a polymer thick film nonconductive layer is applied to the polymer thick film conductive layer, the polymer thick film dielectric layer, the polymer thick film phosphor layer, and the glass substrate such that the nonconductive layer substantially insulates the polymer thick film conductive layer, the polymer thick film dielectric layer, the polymer thick film phosphor layer and the glass substrate from being touched by a user of the apparatus.

In addition, there is another preferred embodiment of the present invention wherein the glass substrate includes a layer having a design which is visible at least when power is applied to the power connective means such that, when power is applied to the power connective means, the polymer thick film phosphor ink layer illuminates and light substantially shows through the layer having a design which is visible at least when power is applied to the power connective means and through the second surface of the glass.

The present invention also provides for an apparatus for providing animated lighted areas on a surface. Such an apparatus comprises a glass substrate having at least a first surface that includes a substantially clear substantially conductive layer, and a second surface that does not include a substantially clear substantially conductive layer. The present invention also includes a polymer thick film phosphor ink layer applied to the substantially clear substantially conductive layer of the glass substrate, a polymer thick film dielectric layer applied to the phosphor ink layer, polymer thick film conductive strips applied to a plurality of portions of the polymer thick film dielectric layer and to at least a portion of the substantially clear substantially conductive layer of the glass substrate, and power connective means for connecting electrical power to the polymer thick film conductive strips associated with the polymer thick film dielectric layer and to the polymer thick film conductive strip associated with the substantially clear substantially conductive layer of the glass substrate. When power is applied to the power connective means, portions of the polymer thick film phosphor ink layer illuminate and light substantially shows through the second surface of the glass. Then the power is applied to and removed from the power connective means selectively and in such a sequence that the portions of the polymer thick film phosphor ink layer are illuminated and darkened to provide animation as seen through the second surface of the glass substrate.

In a preferred embodiment of the invention, the polymer thick film conductive strip includes a material selected from the group consisting of copper, silver, gold, and carbon. In yet another preferred embodiment of the invention, the power connective means is attached to at least a portion of the polymer thick film conductive strips by use of a solder connection, a conductive adhesive, compression of a conductive leaf spring on the polymer thick film conductive strip and the substantially clear substantially conductive layer, compression of conductive rubber on the polymer thick film conductive strip and the substantially clear substantially conductive layer. In another embodiment of the present invention, the apparatus further comprises a non-conductive layer applied to the polymer thick film conductive strips, the polymer thick film dielectric layer, the polymer thick film phosphor layer, and the glass substrate such that the non-conductive layer substantially insulates the polymer thick film conductive strips, the polymer thick film dielectric layer, the polymer thick film phosphor layer and the glass substrate from being touched by a user of the apparatus.

In another preferred embodiment of the present invention, the glass substrate also includes a layer having a design which is visible at least when power is applied to the power connective means such that, when power is applied to the power connective means, the polymer thick film phosphor ink layer illuminates and light substantially shows through the layer having a design which is visible at least when power is applied to the power connective means and through the second surface of the glass substrate.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The above and other features and advantages of the invention will become further known from the following detailed description of preferred embodiments of the invention in conjunction with the drawings in which.

DETAILED DESCRIPTION OF THE DRAWINGS

Figure 1:
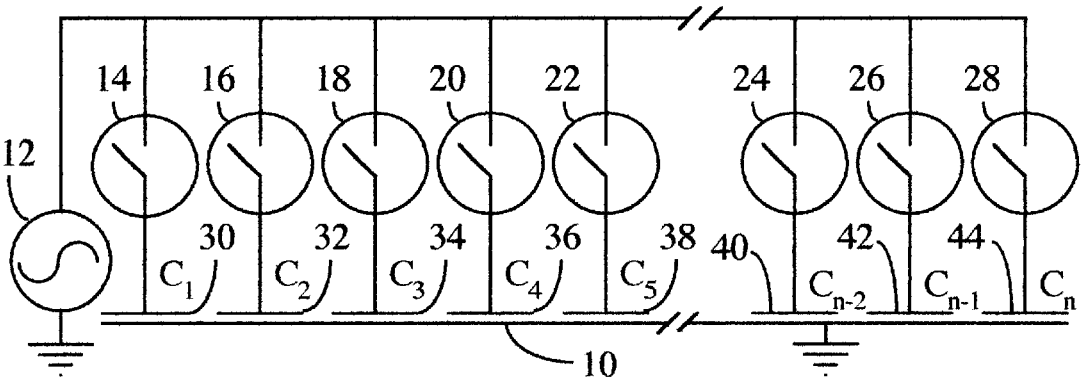
FIG. 1 is a drawing of a simplified schematic of an apparatus for providing an animated electroluminescent display according to the present invention.

An animated electroluminescent display is constructed by screen-printing multiple layers of thermoset polymer thick film (PTF) inks on a glass substrate. Referring now to the drawings in which like reference characters designate like or corresponding parts throughout the several views, FIG. 1 shows a drawing of a simplified schematic of an apparatus for providing an animated electroluminescent display according to the present invention. There are several parallel plate capacitors $C_1$–$C_n$ with a common transparent electrode 10. The power to the capacitors is supplied by the alternating current supply 12 through the switches 14–28. When the switches 14–28 are operated sequentially, the alternating current is applied to the capacitors $C_1$–$C_n$ sequentially.

The individual plates 30–44 attached to the switches $S_l$ through $S_n$ 14–28 are made with an opaque PTF conductive material screen printed and cured on top of the high dielectric constant PTF ink layer. The opaque conductive material can include, but is not restricted to copper, silver, gold, or carbon. The individual plates 30–44 each represent a single frame or element of an animation sequence. For example, if the animation depicts a bird in flight, the plate 30 would be shaped like a bird with its wings open, the plate 32, in close proximity to but not touching the plate 30, would be shaped like a bird with its wings closed, the plate 34, in close proximity to but not touching the plate 32, would be shaped like a bird with its wings open, and so on, with the plate 44 representing the final frame of the sequence.

In operation, electric power from an alternating current source 48 is applied sequentially by opening and closing switches 14–28. The switches 14–28 may be standard high voltage switching transistors or integrated circuits activated by a preset or programmable sequencer. The applied power is an AC voltage that energizes the phosphor ink layer directly below the individual plates 30–44. Voltage requirements will vary with the size of the individual plates but will be typically in the range of from about 300 to about 400 volts peak to peak at a frequency in the range of from about 50 Hz to about 5 kHz with the more useful frequency in the range of about 1 kHz. When viewed through non-conductive side of the glass substrate, to which the common transparent plate 10 is adhered, the animation is seen as a moving display of glowing lights with each light having the same shape as its mutual individual plate 30–44.

Figure 2:
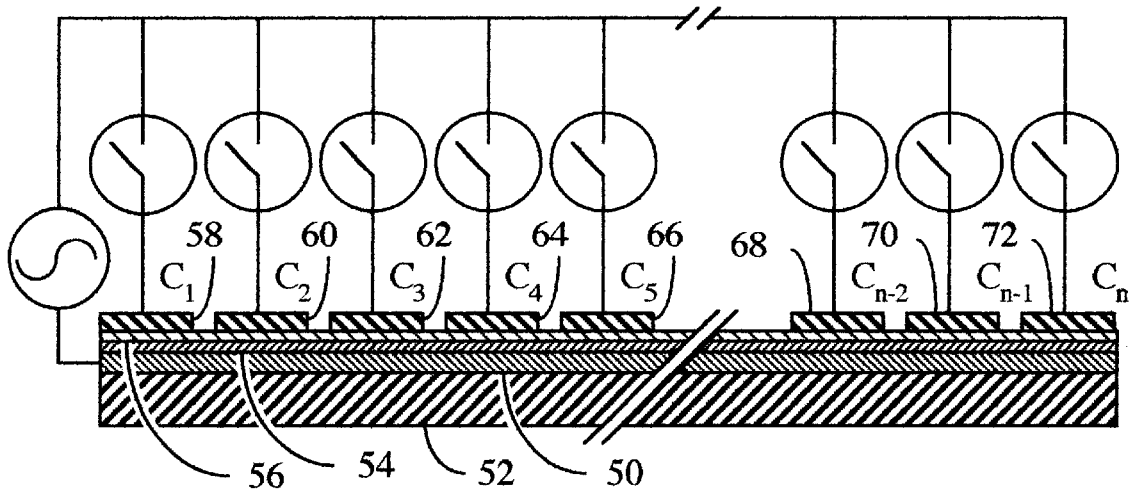
FIG. 2 is a cross sectional representation of the schematic of FIG. 1.

FIG. 2 is a cross sectional drawing of an apparatus for providing an animated electroluminescent display as depicted in FIG. 1 and includes several parallel plate capacitors $C_1$–$C_n$ with a common electrode. The common electrode is a translucent conductor 50 on a glass substrate 52. The dielectric of the capacitors is formed by screen-printing a phosphor PTF ink layer 54 on top of the translucent conductor 50 and over the surface of the glass substrate 52. The choice of the proper phosphor polymer thick film in is made on the basis of use of the apparatus. Different colors of illumination will result from the use of different phosphor polymer thick film inks. A second coat of PTF ink 56 with a high dielectric constant (also known as "high K dielectric ink ") is then printed and cured over the entire surface of the phosphor PTF ink layer 54. The two layers 54 and 56 form an insulator of high dielectric strength and relatively high dielectric constant. The individual plates 58–72 of the parallel plate capacitors $C_1$–$C_n$ are screen-printed with a conductive material, such as copper, carbon, gold, and so forth. Connections to the extended circuitry (such as control circuits, not shown) are made by either soldering wires to the plates 58–72, pressure contacts through conductive rubber or metallic springs in contact with the plates 58–72, or conductive adhesives attached to the plates 58–72.

Figure 3:
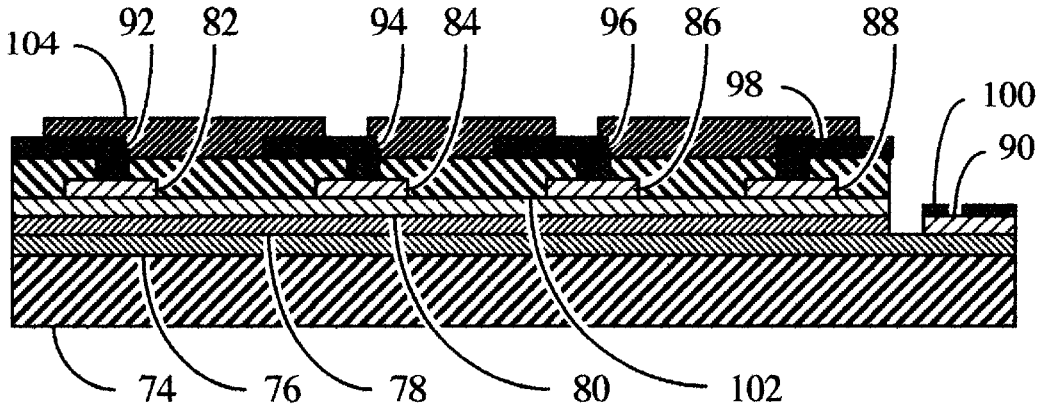
FIG. 3 is a cross sectional drawing of an apparatus for providing an animated electroluminescent display as in FIG. 2 with the addition of extra polymer thick film layers for the convenience of routing internal electrical connections.

FIG. 3 is a cross sectional drawing of an apparatus similar to FIG. 2 with the addition of a conductive interconnectional layer. As in FIG. 2, there is a glass plate 74 having clear conductive coating 76. Such glass plates 74 with clear conductive coatings 76 are available commercially from, for example, AFG Industries, Inc., of Kingsport, Tennessee, and are known as "low E glass. " Also as in FIG. 2, there are a phosphor PTF ink layer 78, a layer 80 of high K dielectric PTF ink, and individual plates 82–88 of parallel plate capacitors of an opaque PTF conductive material.

Departing from the illustration of FIG. 2, there is a connection 90 of an opaque PTF conductive material screen-printed on the clear conductive coating 76. Electrical connections 92–100 to the individual plates 82–88 and the connection 90 of the clear conductive coating 76 are made by screen printing and curing a layer 102 of an insulating dielectric on top of the previous layers of phosphor 78, high K dielectric 80, and individual plates 82–88. At the point of each required electrical contact, the insulating dielectric layer 102 exhibits a small window that exposes the underlying individual plates 82–88. Traces of conductive ink are screen printed and cured on top of the insulating dielectric layer 102, into the small windows, and onto the connection 90 of the clear conductive coating 76. This results in the formation of the electrical connections 92–100. Each trace 92–98 forms a unique connection through the windows of the insulating dielectric layer 102 and is routed to a location convenient for a connection to an external power source (not shown).

A final overcoat layer 104 of insulating dielectric is printed and cured on top of the multilayered structure which effectively encapsulates all previous layers except the points of external electrical connection and a portion of the clear conductive coating 76. Connections to the traces 92–100 can be made with solder, conductive adhesive, pressure contacts of conductive rubber, or pressure contacts of metallic leaf springs.

Figure 4:
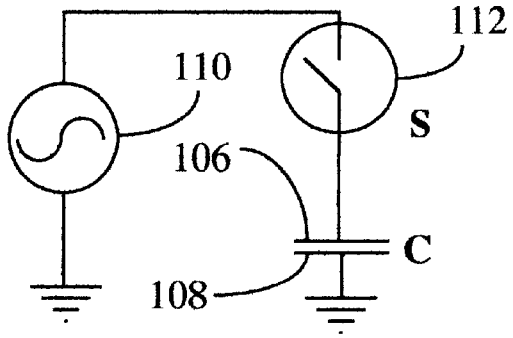
FIG. 4 is a drawing of a simplified schematic of an apparatus for providing an electroluminescent back lighting according to the present invention.

FIG. 4 is a schematic diagram of an electroluminescent back light display that is comparable to a parallel plate capacitor. As can be seen by comparison of FIG. 4 with FIG. 1, a simplified version of the animated display can be used for back lighting. In particular, the backlight of FIG. 4 may be used, for example, for fine art and advertisements for viewing in the dark. As in FIG. 1, FIG. 4 shows a top electrode 106 and bottom electrode 108 of a parallel plate capacitor C. The power to the capacitor is supplied by the alternating current supply 110 and is controlled by the switch 112 (S).

Figure 5:
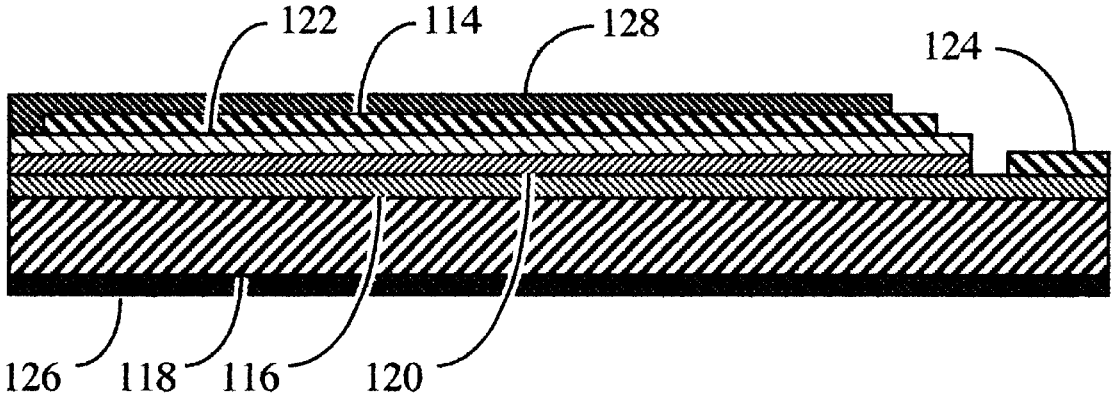
FIG. 5 is a cross sectional drawing of an apparatus for providing an electroluminescent back lighting according to the present invention.

FIG. 5 is a detailed cross sectional drawing of an apparatus for providing an electroluminescent back lighting equivalent to the schematic diagram of FIG. 4. The backlight includes a parallel plate capacitor, C, formed by an opaque top electrode 114 and a translucent bottom electrode 116. The translucent bottom electrode 116 is a translucent layer on a glass substrate 118. Screen-printing a phosphor PTF ink layer 120 on top of the translucent bottom plate 116 forms part of the dielectric of the capacitor. The PTF ink layer 120 is screen-printed over a portion of the surface of the translucent bottom plate 116 with an area left uncovered in order to make an electrical connection with the translucent bottom plate 116. The choice of the proper phosphor polymer thick film ink is made on the basis of use of the apparatus. Different colors of illumination will result from the use of different phosphor polymer thick film inks. A second coat of PTF ink 122 with high K dielectric ink is then printed and cured over the entire surface of the phosphor PTF ink layer 120. The two layers 120 and 122 form an insulator of high dielectric strength and relatively high dielectric constant.

The top electrode 114 is an opaque PTF conductive material screen-printed and cured on top of the high dielectric constant PTF ink layer 122. In addition, opaque PTF conductive material is screen-printed onto a portion of the translucent bottom electrode 116 to provide an electrical connection point 124 for the translucent bottom electrode 116. The opaque conductive materials are any one of a number of conductive materials to provide conductivity to the top electrode 114 and the bottom electrode 116. Such materials include, but are not restricted to copper, silver, gold, or carbon. The top electrode 114 covers the entire surface of the high dielectric constant PTF ink layer 122. A design layer 126 is mounted to the surface of the glass substrate 118 in such a manner that when the phosphor ink layer 120 is illuminated, the design layer 126 is visible in low light situations. The design layer 126 is prepared from a substantially transparent material with a desired design printed on the material. Such materials include, but are not restricted to, materials such as Mylar®. Alternatively, the design layer 126 may be screen-printed directly onto the surface of the glass substrate 118.

In operation, electric power from an alternating current source is applied to the electrodes 114 and 116. The applied power is an AC voltage that energizes the phosphor ink layer 120 directly above the bottom translucent electrode 116. Voltage requirements will vary with the size of the plate but will be typically in the range of from about 300 to about 400 volts peak to peak at a frequency in the range of from about 50 Hz to about 5 kHz with a more useful frequency of about 1 kHz. When viewed through non-conductive side of the glass substrate 118, the design on the design layer 126 is seen as a back light display of a glowing light behind the design layer 126. A dielectric PTF overcoat layer 128 covers a majority of the top electrode 114. A small portion of the top electrode 114 is left uncovered with the overcoat layer 128 in order to make an electrical connection with the top electrode 114.

Thus, the present invention provides an apparatus that will allow the production of light over a limited area. In addition, the present invention provides such an apparatus that is compact in construction. Further, the present invention provides such an apparatus that is simple to construct. Also, the present invention provides such an apparatus that is relatively inexpensive to manufacture.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. An apparatus for providing animated lighted areas on a surface comprising:

a) a glass substrate having at least a first surface wherein the surface includes a substantially clear substantially conductive layer, and a second surface wherein the surface does not include a substantially clear substantially conductive layer;

b) a polymer thick film phosphor ink layer applied to the substantially clear substantially conductive layer of the glass substrate;

c) a polymer thick film dielectric layer applied to the phosphor ink layer;

d) a first polymer thick film conductive strip applied to a portion of the substantially clear substantially conductive layer of the glass substrate;

e) a plurality of second polymer thick film conductive strips, each of the plurality of second polymer thick film conductive strips applied to one of a plurality of portions of the polymer thick film dielectric layer;

f) power connective means for connecting an electrical power source to the plurality of second polymer thick film conductive strips associated with the polymer thick film dielectric layer and to the first polymer thick film conductive strip associated with the substantially clear substantially conductive layer of the glass substrate; and g) a switching circuit connecting said electrical power source to said power connective means, said switching circuit sequentially energizing each of said plurality of second polymer thick film conductive strips;

wherein when power is applied to the power connective means, portions of the polymer thick film phosphor ink layer illuminate and light substantially shows through the second surface of the glass, and wherein the power is applied to and removed from the power connective means selectively and in such a sequence that the portions of the polymer thick film phosphor ink layer are illuminated and darkened to provide animation as seen through the second surface of the glass substrate.

2. The apparatus of claim 1 wherein the first polymer thick film conductive strip includes a material selected from the group consisting of copper, silver, gold, and carbon, and the plurality of second polymer thick film conductive strips includes a material selected from the group consisting of copper, silver, gold, and carbon.

3. The apparatus of claim 1 wherein the power connective means is attached to at least a portion of the first polymer thick film conductive strip and a portion of the plurality of second polymer thick film conductive strips with a solder connection.

4. The apparatus of claim 1 wherein the power connective means is attached to at least a portion of the first polymer thick film conductive strip and a portion of the plurality of second polymer thick film conductive strips with a conductive adhesive.

5. The apparatus of claim 1 wherein the power connective means is attached to at least a portion of the first polymer thick film conductive strip and a portion of the plurality of second polymer thick film conductive strips by compression of a conductive leaf spring on the polymer thick film conductive strip and the substantially clear substantially conductive layer.

6. The apparatus of claim 1 wherein the power connective means is attached to at least a portion of the first polymer thick film conductive strip and a portion of the plurality of second polymer thick film conductive strips by compressed conductive rubber between the power connective means and said portion of the first polymer thick film conductive strip and between the power connective means and said portion of the plurality of second polymer thick film conductive strips.

7. The apparatus of claim 1 further comprising a non-conductive layer applied to the first polymer thick film conductive strip and the plurality of second polymer thick film conductive strips, the polymer thick film dielectric layer, the polymer thick film phosphor layer, and the glass substrate such that the non-conductive layer substantially insulates the first polymer thick film conductive strip and the plurality of second polymer thick film conductive strips, the polymer thick film dielectric layer, the polymer thick film phosphor layer and the glass substrate from being touched by a user of the apparatus.

8. The apparatus of claim 1 wherein the glass substrate includes a layer having a design which is visible at least when power is applied to the power connective means such that, when power is applied to the power connective means, the polymer thick film phosphor ink layer illuminates and light substantially shows through the layer having a design which is visible at least when power is applied to the power connective means and through the second surface of the glass substrate.

9. An apparatus for providing a plurality of illuminated areas on a surface that are selectively illuminated, said apparatus comprising:

a glass substrate having a first surface, a conductive layer in contact with said first surface of said substrate, said conductive layer being substantially clear, said conductive layer overlaying a first portion of said first surface;

a phosphor layer in contact with said conductive layer, said phosphor layer overlaying a second portion of said conductive layer, said phosphor layer being a polymer thick film ink, said phosphor layer being a thermosetting polymer;

a dielectric layer in contact with said phosphor layer, said dielectric layer overlaying a third portion of said phosphor layer, said dielectric layer being a polymer thick film ink, said dielectric layer being a thermosetting polymer having a high dielectric constant;

a plurality of image layers in contact with said dielectric layer, each of said plurality of image layers overlaying one of a plurality of selected portions of said dielectric layer, each of said plurality of image layers insulated from others of said plurality of image layers, said plurality of image layers being formed from a polymer thick film ink, said plurality of image layers being formed from a thermosetting polymer that is conductive;

a power supply having a first power output connection and a second power output connection;

a first electrical connection between said conductive layer and said first power output connection;

a switching circuit connected to said second power output connection;

a plurality of second electrical connections, each of said plurality of second electrical connections between one of said plurality of image layers and said switching circuit, wherein said plurality of image layers is selectively and sequentially energized by said power supply.

10. The apparatus of claim 9 further including an insulating layer substantially overlaying said plurality of image layers and said dielectric layer.

11. The apparatus of claim 9 further including a design layer in contact with a second surface of said glass substrate, said design layer having a pattern visible when at least one of said plurality of image layers is energized by said power supply.

12. An apparatus for providing a plurality of illuminated areas on a surface that are selectively illuminated, said apparatus comprising:

a means for illuminating a plurality of selected areas of a transparent substrate with a thermosetting polymer thick film; and a means for selectively providing power to said means for illuminating said plurality of selected areas.

13. The apparatus of claim 1 wherein said polymer thick film phosphor ink layer, said polymer thick film dielectric layer, said first polymer thick film conductive strip, and said plurality of second polymer thick film conductive strips are a thermosetting polymer.

* * * * *